United States Patent [19]

Tabb

[11] Patent Number: 5,045,893

[45] Date of Patent: Sep. 3, 1991

[54] HIGHLIGHT PRINTING APPARATUS

[75] Inventor: Charles H. Tabb, Penfield, N.Y.

[73] Assignee: Xerox Corporation, Stamford, Conn.

[21] Appl. No.: 548,327

[22] Filed: Jul. 2, 1990

[51] Int. Cl.[5] ..... G03G 15/01

[52] U.S. Cl. ..... 355/328; 355/77; 430/42

[58] Field of Search ..... 355/328, 77, 251, 246; 430/42, 122

[56] References Cited

U.S. PATENT DOCUMENTS

| | | | |
|---|---|---|---|
| 4,078,929 | 3/1978 | Sundlach | 96/1.2 |
| 4,562,130 | 10/1985 | Oka | 430/54 |
| 4,731,634 | 3/1988 | Stark . | |
| 4,761,668 | 8/1988 | Parker et al. | 355/3 DD |
| 4,761,672 | 8/1988 | Parker et al. | 355/14 D |
| 4,771,314 | 9/1988 | Parker et al. | 355/4 |
| 4,811,046 | 3/1989 | May | 355/4 |
| 4,833,504 | 5/1989 | Parker et al. | 355/326 |
| 4,847,655 | 7/1989 | Parker et al. | 355/328 X |
| 4,868,611 | 9/1989 | Germain | 355/328 |
| 4,901,100 | 2/1990 | Diabianca | 355/328 |
| 4,901,114 | 2/1990 | Parker et al. | 355/245 |
| 4,937,636 | 6/1990 | Rees et al. | 355/328 |

*Primary Examiner*—R. L. Moses .

[57] ABSTRACT

Apparatus and method of forming plural images, wherein the method includes the steps of: uniformly charging a charge retentive belt; discharging portions of the uniformly charged belt to form relatively high and low voltage areas of the same polarity on the belt; providing a high resolution development system; providing an electrical bias for said development system such that a relatively large development field is provided between said developer structure forming a part of the development system and the relatively low voltage; using the high resolution development system, developing the areas of relatively low voltage with first toner material contained in the developer structure; discharging portions of the relatively high voltage areas of the charge retentive belt to form areas at a voltage level intermediate the relatively high and low voltage areas; and developing the areas of high voltage level with a second toner material which is distinct and of opposite polarity from said first toner material.

19 Claims, 4 Drawing Sheets

HIGHLIGHT PRINTING APPARATUS

BACKGROUND OF THE INVENTION

This invention relates generally to the rending of latent electrostatic images visible using multiple colors of dry toner or developer and, more particularly, to a high speed, highlight printer which exhibits high copy quality without degradation of process speed.

The invention can be utilized in the art of xerography or in related printing arts. In the practice of conventional xerography, it is the general procedure to form electrostatic latent images on a xerographic surface by first uniformly charging a photoconductive insulating surface or photoreceptor. The charge is selectively dissipated in accordance with a pattern of activating radiation corresponding to original images. The selective dissipation of the charge leaves a latent charge pattern on the imaging surface corresponding to the areas not struck by radiation.

This charge pattern is made visible by developing it with toner. The toner is generally a colored powder which adheres to the charge pattern by electrostatic attraction.

The developed image is then fixed to the imaging surface or is transferred to a receiving substrate such as plain paper to which it is fixed by suitable fusing techniques.

Multi-color imaging has also been accomplished utilizing basic xerographic techniques. In this instance, the foregoing process is essentially repeated for three or four cycles. Thus, the charged photoconductive surface is successively exposed to filtered light images. After each exposure the resultant electrostatic latent image is then developed with toner particles corresponding in color to the subtractive primary of the filtered light image. For example, when a red filter is employed, the electrostatic latent image is developed with toner particles which are cyan in color. The cyan toner powder image is then transferred to the copy sheet. The foregoing process is repeated for a green filtered light image which is developed with magenta toner particles and a blue filtered light image which is developed with yellow toner particles.

Each differently colored toner powdered image is sequentially transferred to the copy sheet in superimposed registration with the powder image previously transferred thereto. In this way, three or more toner powder images are transferred sequentially to the copy sheet. After the toner powder images have been transferred to the copy sheet, they are permanently fused thereto. The foregoing color imaging process is known as full color imaging.

Another color imaging process is known as highlight color imaging. In highlight color imaging two different color developers are customarily employed, usually black and some other color, for example, red. In one type of highlight color imaging, a tri-level image is formed on the imaging surface utilizing a three level ROS (Raster Output Scanner) to form the tri-level image on a charge retentive surface that had previously been uniformly charged. The tri-level image comprises two image areas and a background area.

The concept of tri-level xerography is described in U.S. Pat. No. 4,078,929 issued in the name of Gundlach. The patent to Gundlach teaches the use of tri-level xerography as a means to achieve single-pass highlight color imaging. As disclosed therein, the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development system is biased to about the background voltage. Such biasing results in a developed image of improved color sharpness.

In tri-level xerography, the xerographic contrast on the charge retentive surface or photoreceptor is divided three, rather than two, ways as is the case in conventional xerography. The photoreceptor is charged, typically to 900 v. It is exposed imagewise, such that one image corresponding to charged image areas (which are subsequently developed by charged area development, i.e. CAD) stays at the full photoreceptor potential ($V_{ddp}$ or $V_{cad}$, [see FIGS. 1*a* and 1*b*]). The other image is exposed to discharge the photoreceptor to its discharge potential, i.e. $V_c$ or $V_{dad}$ (typically 100 v) which corresponds to discharged area images that are subsequently developed by discharged-area development (DAD). The background areas exposed such as to reduce the photoreceptor potential to halfway between the $V_{cad}$ and $V_{dad}$ potentials, (typically 500 v) and is referred to as $V_w$ or $V_{white}$. The CAD developer is typically biased about 100 v closer to $V_{cad}$ than $V_{white}$ (about 600 v), and the DAD developer system is biased about 100 v closer to $V_{dad}$ than $V_{white}$ (about 400 v).

Because the composite image developed on the charge retentive surface consists of both positive and negative toner a pre-transfer corona charging step is necessary to bring all the toner to a common polarity so it can be transferred using corona charge of the opposite polarity.

As will be appreciated, a highlight color printer which is capable of a high degree of copy quality at a relatively high process speed is quite desirable. However, to date no acceptable system that incorporates both of these characteristics has been identified. Considered have been two pass highlight color systems using insulative magnetic brush (IMB) black development which would satisfy the goal of high quality and single pass systems (Tri-level Xerography) which would satisfy the latter goal but with a compromise in black copy quality.

Various techniques have heretofore been employed to create and develop electrostatic images as illustrated by the following disclosures which may be relevant to certain aspects of the present invention.

U.S. Pat. No. 4,761,668 granted to Parker et al and assigned to the same assignee as the instant application which relates to tri-level printing discloses apparatus for minimizing the contamination of one dry toner or developer by another dry toner or developer used for rendering visible latent electrostatic images formed on a charge retentive surface such as a photoconductive imaging member. The apparatus causes the otherwise contaminating dry toner or developer to be attracted to the charge retentive surface in its inter-document and outboard areas. The dry toner or developer so attracted is subsequently removed from the imaging member at the cleaning station.

U.S. Pat. No. 4,761,672 granted to Parker et al and assigned to the same assignee as the instant application which relates to tri-level printing discloses apparatus wherein undesirable transient development conditions that occur during start-up and shut-down in a tri-level xerographic system when the developer biases are either actuated or deactuated are obviated by using a control strategy that relies on the exposure system to generate a spatial voltage ramp on the photoreceptor during machine start-up and shut-down. Furthermore, the development systems' bias supplies are programmed so that their bias voltages follow the photoreceptor voltage ramp at some predetermined offset voltage. This offset is chosen so that the cleaning field between any development roll and the photoreceptor is always within reasonable limits. As an alternative to synchronizing the exposure and developing characteristics, the charging of the photoreceptor can be varied in accordance with the change of developer bias voltage.

U.S. Pat. No. 4,811,046 granted to Jerome E. May and assigned to the same assignee as the instant application which relates to tri-level printing discloses apparatus wherein undesirable transient development conditions that occur during start-up and shut-down in a tri-level xerographic system when the developer biases are either actuated or deactuated are obviated by the provision of developer apparatuses having rolls which are adapted to be rotated in a predetermined direction for preventing developer contact with the imaging surface during periods of start-up and shut-down. The developer rolls of a selected developer housing or housings can be rotated in the contact-prevention direction to permit use of the tri-level system to be utilized as a single color system or for the purpose of agitating developer in only one of the housings at a time to insure internal triboelectric equilibrium of the developer in that housing.

U.S. Pat. No. 4,771,314 granted to Parker et al and assigned to the same assignee as the instant application which relates to tri-level printing discloses printing apparatus for forming toner images in black and at least one highlighting color in a single pass of a charge retentive imaging surface through the processing areas, including a development station, of the printing apparatus. The development station includes a pair of developer housings each of which has supported therein a pair of magnetic brush development rolls which are electrically biased to provide electrostatic development and cleaning fields between the charge retentive surface and the developer rolls. The rolls are biased such that the development fields between the first rolls in each housing and the charge retentive surface are greater than those between the charge retentive surface and the second rolls and such that the cleaning fields between the second rolls in each housing and the charge retentive surface are greater than those between the charge retentive surface and the first rolls.

U.S. Pat. No. 4,833,504 granted to Delmer Parker and assigned to the same assignee as the instant application which relates to tri-level printing discloses a magnetic brush developer apparatus comprising a plurality of developer housings each including a plurality of magnetic rolls associated therewith. The magnetic rolls disposed in a second developer housing are constructed such that the radial component of the magnetic force field produces a magnetically free development zone intermediate a charge retentive surface and the magnetic rolls. The developer is moved through the zone magnetically unconstrained and, therefore, subjects the image development by the first developer housing to minimal disturbance. Also, the developer is transported from one magnetic roll to the next. This apparatus provides an efficient means for developing the complementary half of a tri-level latent image while at the same time allowing the already developed first half to pass through the second housing with minimum image disturbance.

U.S. Pat. No. 4,901,114 issued on Feb. 13, 1990 in the name of Parker et al and assigned to the same assignee as the instant application which relates to tri-level printing discloses an electronic printer employing tri-level xerography to superimpose two images with perfect registration during the single pass of a charge retentive member past the processing stations of the printer. One part of the composite image is formed using Magnetic Ink Character Recognition (MICR) toner, while the other part of the image is printed with less expensive black, or color toner. For example, the magnetically readable information on a check is printed with MICR toner and the rest of the check in color or in black toner that is not magnetically readable.

U.S. Pat. No. 4,868,611 issued in the name of Richard P. Germain on Sept. 19, 1989 discloses a highlight color imaging method and apparatus including structure for forming a single polarity charge pattern having at least three different voltage levels on a charge retentive surface wherein two of the voltage levels correspond to two image areas and the third voltage level corresponds to a background area. Interaction between developer materials contained in a developer housing and an already developed image in one of the two image areas is minimized by the use of a scorotron to neutralize the charge on the already developed image.

U.S. Pat. No. 4,562,130 granted to Tateki Oka on Dec. 31, 1985 discloses a method of forming composite images wherein a first electrostatic latent image of positive image is formed on a photosensitive member after which a scorotron charger is used to correct the potential of the background area to an intermediate potential. This is followed by the formation of a second latent image by exposing the intermediate potential to a negative image.

U.S. patent application Ser. No. 07/332,087 filed on Apr. 3, 1989 in the name of Charles Tabb discloses an imaging method and apparatus utilizing some of the features of both single and two pass highlight color imaging. Both developer housings are always actively engaged. One housing is used to charged area development (CAD) and the other is used for discharged area development (DAD). The developer housing biases are switched or adjusted in order to preclude unwanted image development. When the DAD image moves through the CAD housing the CAD bias is switched to bias away the developer in the CAD developer housing. Likewise, when the CAD image moves through the DAD housing its bias will be switched to bias away the DAD developer.

BRIEF SUMMARY OF THE INVENTION

In accordance with the present invention there is disclosed a single pass printer which utilizes two image systems for forming latent electrostatic images on charge retentive belt photoreceptor. After the charge retentive belt is uniformly charged, a 600 SPI Raster Output Scanner (ROS) or other device in a "write black" mode forms a bi-level (i.e. background and image areas) latent electrostatic image. The bi-level image is then developed using an insulated Magnetic Brush (IMB), HAZE (Highly Agitated Zone), MAZE (Magnetically Agitated ZONE) or other "high resolution" development system using Discharge Area Development (DAD) with negative black toner and positive carrier. The next step comprises forming a second image with a "low UMC (unit manufacturing cost)" 300 spi imaging device which images in the write white mode exposing all non-developed charged areas except those to be developed in color. This photodischarge step is of an "intermediate exposure" designed to photodischarge the background area of the original bi-level image to a voltage level comparable to the partially neutralized black image. This second imaging step is followed by a second development step as the image passes through a second development housing. The second development housing is a tri-level type housing (i.e. multi-roll, Conductive Magnetic Brush (CMB) development system that exhibits a low development field. The second development housing contains a positive charging color toner and negative carrier.

DETAILED DESCRIPTION OF THE PREFERRED EMBODIMENT OF THE INVENTION

Figure 1A:
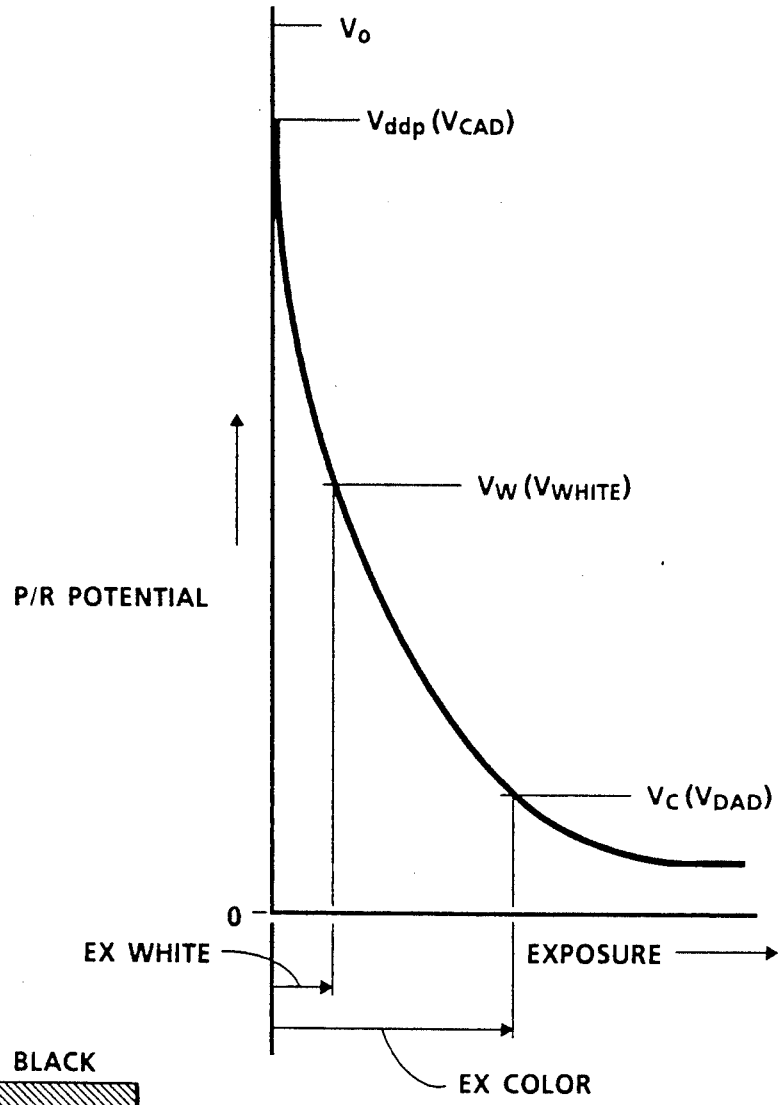
FIG. 1*a* is a plot of photoreceptor potential versus exposure illustrating a tri-level electrostatic latent image.
Figure 1B:
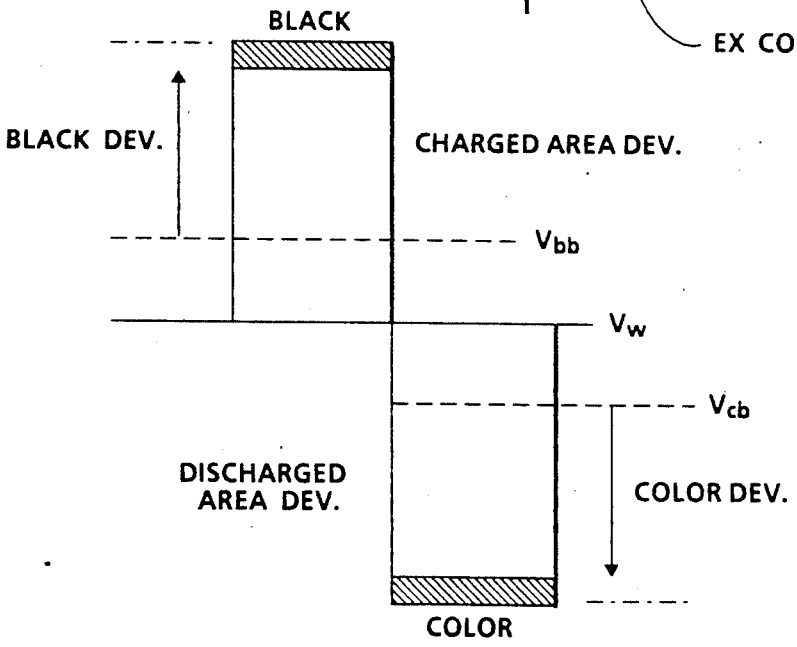
FIG. 1*b* is a plot of photoreceptor potential illustrating singlepass, highlight color latent image characteristics.
Figure 2:
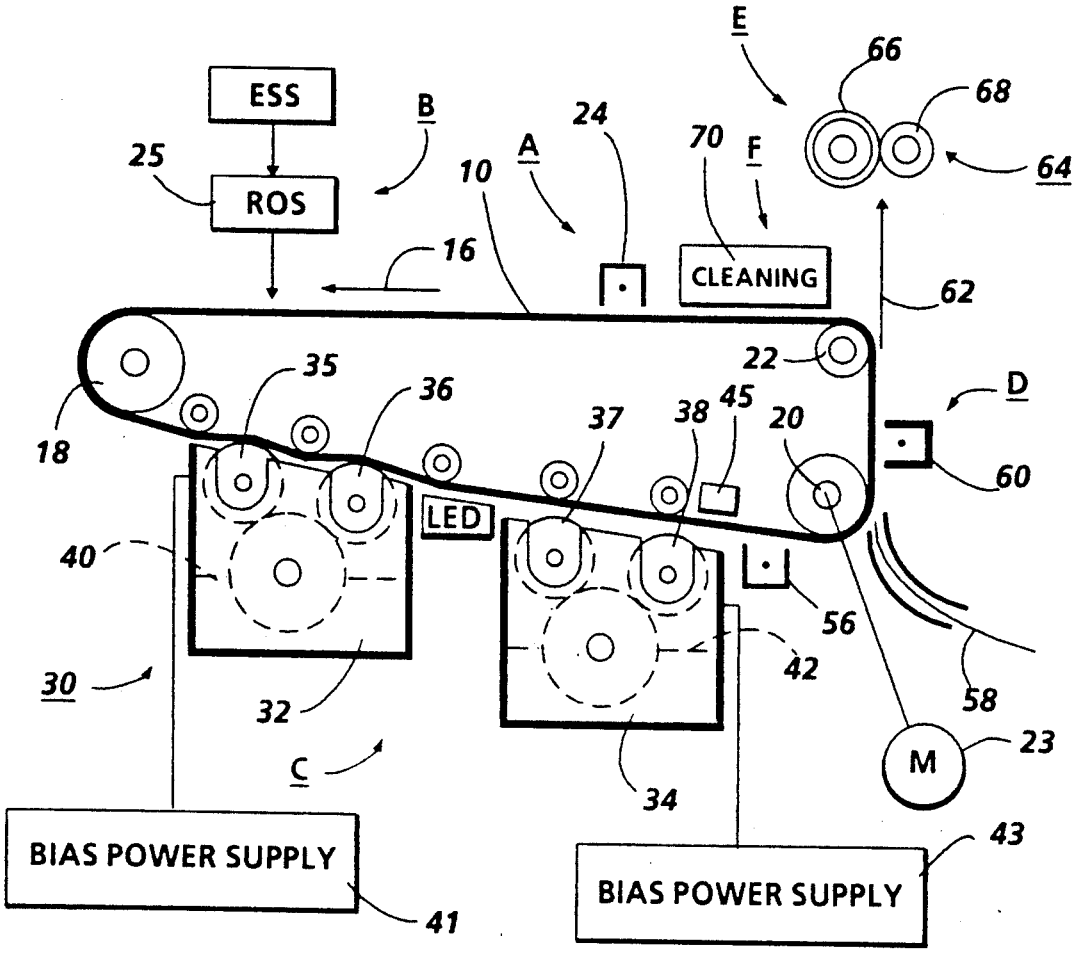
FIG. 2 is schematic illustration of a printing apparatus incorporating the inventive features of our invention.

As shown in FIG. 2, a printing machine incorporating the invention utilizes a charge retentive member in the form of a photoconductive belt 10 consisting of a photoconductive surface and an electrically conductive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10 and the latter of which can be used as a drive roller. Motor 23 rotates roller 20 to advance belt 10 in the direction of arrow 16. Roller 20 is coupled to motor 23 by suitable means such as belt drive.

As can be seen by further reference to FIG. 2, initially successive portions of belt 10 pass through charging station A. At charging station A, a corona discharge device such as a scorotron, corotron or dicorotron indicated generally by the reference numeral 24, charges the belt 10 to a selectively high uniform predetermined negative potential. Alternatively, the belt may be charged to a uniform predetermined positive potential. Any suitable control, well known in the art, may be employed for controlling the corona discharge device 24.

Figure 3A:
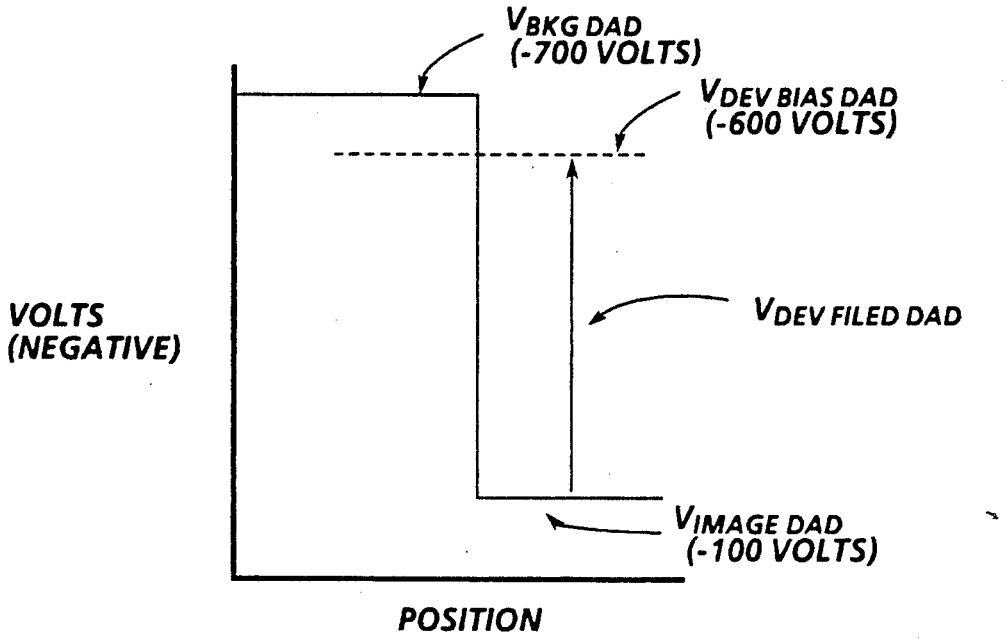
FIG. 3*a* depicts the voltage profile on a charge retentive surface after a first exposure step.

Next, the uniformly charged portions of the photoreceptor surface are advanced through exposure station B. At exposure station B, the uniformly charged belt photo receptor or charge retentive surface 10 is exposed to a laser based input and/or output scanning device 25 which causes the charge retentive surface to be discharged to form bi-level images, each comprising a background level $V_{bkg\ DAD}$ of about −700 volts and a discharged image area, $V_{image\ DAD}$ of approximately −100 volts (FIG. 3*a*). The scanning device 25 is a two level, 600 Spots Per Inch (SPI) Raster Output Scanner (ROS). Other exposure devices such as LED bars may be employed in lieu of the device 25.

At development station C, a magnetic brush development system, indicated generally by the reference numeral 30 advances developer materials into contact with electrostatic latent images on the photorecepter. The development system 30 comprises first and second developer housings 32 and 34. Preferably, each magnetic brush development housing includes a plurality of magnetic brush developer rollers. Thus, the housing 32 contains a pair of rollers 35, 36 while the housing 34 contains a pair of magnetic brush rollers 37, 38. Each pair of rollers advances its respective developer material into contact with the latent image. Appropriate developer biasing is accomplished via power supplies 41 and 43 electrically connected to respective developer housings 32 and 34.

Figure 3B:
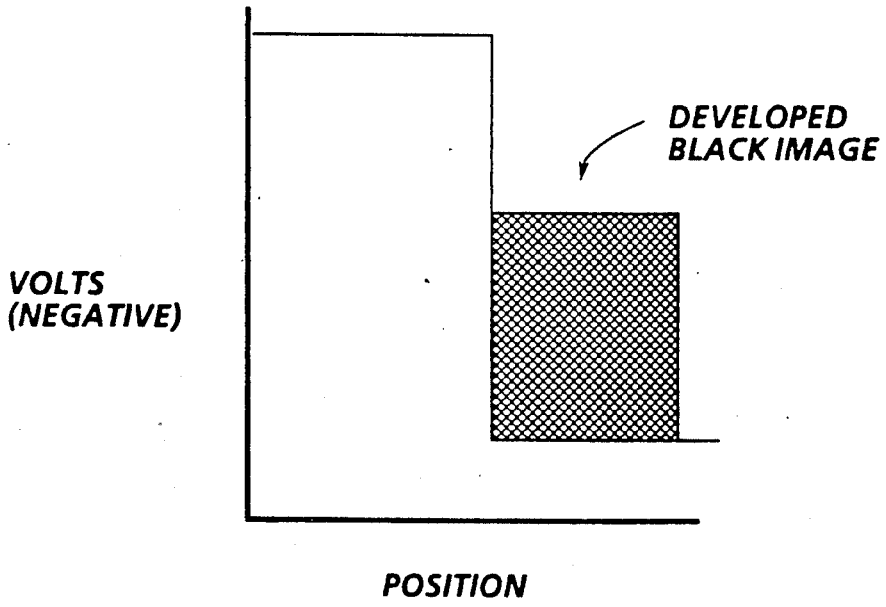
FIG. 3*b* depicts the charge retentive surface of FIG. 3*a* after development of the first image formed by the first exposure step.

The discharged area, $V_{image\ DAD}$ of the bi-level image is developed using an insulated Magnetic Brush (IMB), HAZE (Highly Agitated Zone), MAZE (Magnetically Agitated Zone) or other "high resolution" development system using Discharge Area Development (DAD) with Haze or Maze development system consists of the photoreceptor belt 10 urged into intimate contact with rollers 35 and 36 to effect the agitated zone. The photoreceptor voltage profile and development black image are illustrated in FIG. 3*b*. For proper development of the bi-level image, the developer rolls 32 and 34 are electrically biased to voltage, $V_{dev\ bias\ DAD}$ equal to approximately −600 volts. With such biasing of the developer rolls, a relatively large development field, $V_{dev\ field\ DAD}$ is provided.

Figure 3C:
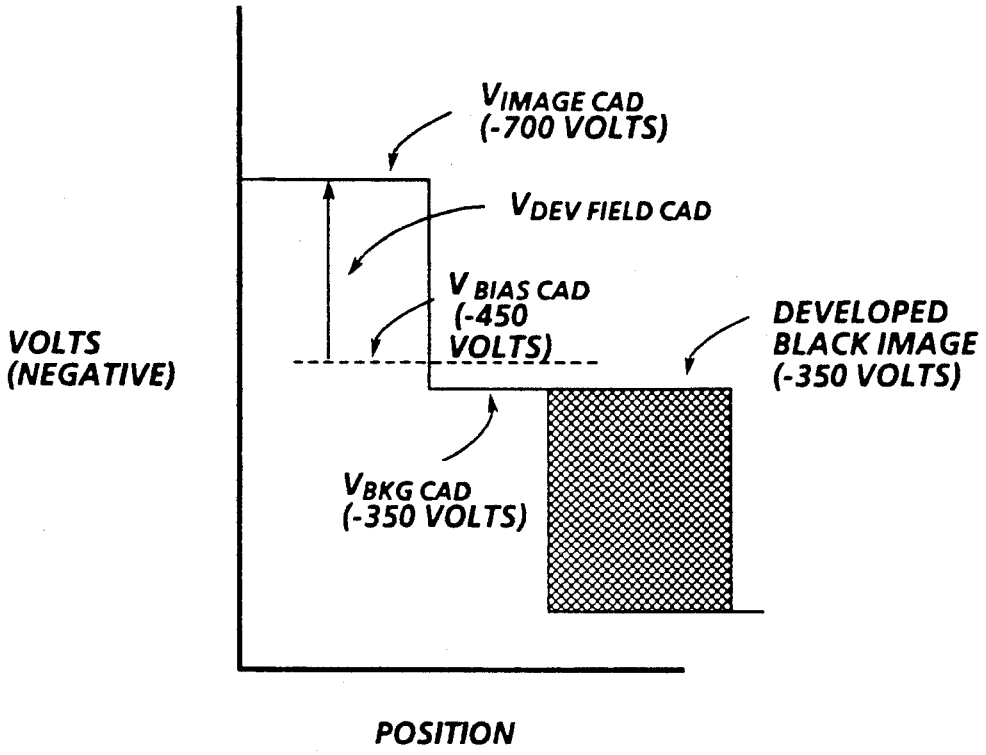
FIG. 3*c* depicts the charge retentive surface subsequent to a second exposure step.

Subsequent to development of the bi-level image, a second image is formed with a "low UMC (unit manufacturing cost)" 300 spi imaging device, for example a light emitting diode (LED) away 48 disposed intermediate the developer housing 32 and 34. The imaging device 48 discharges all non-developed charged areas of the bi-level image except those to be developed in color. This results in a second bi-level image (FIG. 3*c*) comprising a discharged area voltage level, $V_{bkg\ CAD}$ of approximately −350 volts and an image area voltage level, $V_{image\ CAD}$ of approximately −700 volts. This photodischarge step is of an "intermediate exposure" designed to photodischarge the background area of the original bi-level image to a voltage level comparable to the partially neutralized black image.

Figure 3D:
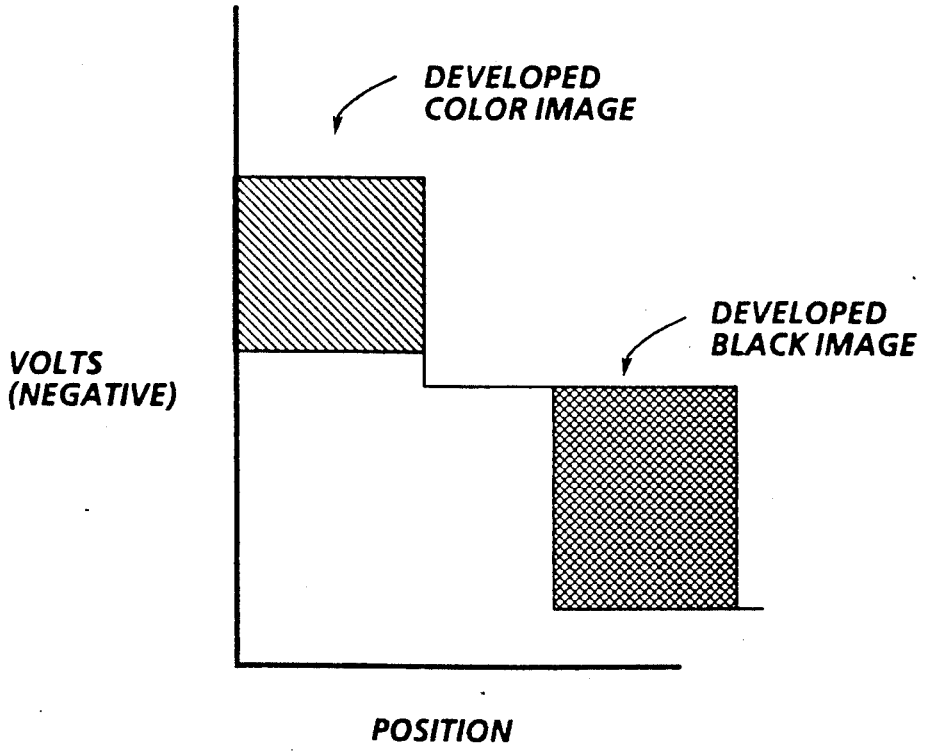
FIG. 3*d* depicts the charge retentive surface after a second development step.

The second imaging step is followed by a second development step as the image passes through the second development housing 34. The second development housing is a tri-level housing (i.e. multi-roll, Conductive Magnetic Brush (CMB) development system that exhibits a low development field. It contains a positive charging color toner and negative carrier. For development of the colored image, the developer rolls 37 and 38 are electrically biased to a voltage of approximately −450 volts resulting in a relatively small development field, $V_{dev\,field\,CAD}$. The voltage profile of both the developed black and color images are depicted in FIG. 3*d*.

Because the composite image developed on the photoreceptor consists of both positive and negative toner, an erase member indicated by reference character 55 together with a suitable pre-transfer corona discharge member 56 using either negative or positive corona discharge are provided to condition the toner for effective transfer to a substrate.

A sheet of support material 58 (FIG. 2) is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack of copy sheet. Feed rolls rotate so as to advance the uppermost sheet from stack into a chute which directs the advancing sheet of support material into contact with photoconductive surface of belt 10 in a timed sequence so that the toner powder images developed thereon contact the advancing sheet of support material at transfer station D.

Transfer station D includes a corona generating device 60 which sprays ions of a suitable polarity onto the backside of sheet 68. This attracts the charged toner powder images from the belt 10 to sheet 58. After transfer, the sheet continues to move, in the direction of arrow 62, onto a conveyor (not shown) which advances the sheet to fusing station E. A detack corona generating device (not shown) may also be employed.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. A cleaner housing 70 is disposed at the cleaner station F. The cleaning station F also may contain a pre-clean corona device, not show.

Subsequent to cleaning, a discharge lamp (not shown) floods the photoconductive surface with light to dissipate any residual electrostatic charge remaining prior to the charging thereof for the successive imaging cycle.

What is claimed is:

1. The method of forming plural images, said method including the steps of:

uniformly charging a charge retentive belt;

discharging portions of said uniformly charged retentive belt to form relatively high and low voltage areas of the same polarity on said belt;

providing a high resolution development system;

providing an electrical bias for said development system such that a relatively large development field is provided between said developer structure forming a part of said development system and said relatively low voltage areas;

using said high resolution development system, developing said areas of relatively low voltage with first toner material contained in said developer structure;

discharging portions of said relatively high voltage areas of said charge retentive belt to form areas at a voltage level intermediate said relatively high and low voltage areas; and developing the remaining areas of high voltage level with a second toner material which is distinct and of opposite polarity from said first toner material leaving said intermediate voltage background level undisturbed.

2. The method according to claim 1 wherein said high resolution development system comprises a plurality of developer rolls positioned in intimate contact with said charge retentive belt.

3. The method according to claim 2 wherein said relatively high and low voltage areas are formed using a 600 SPI raster output scanner.

4. The method according to claim 3 wherein the discharging of portions of said relatively high voltage areas of said charge retentive belt to a voltage level intermediate said relatively high and low voltage areas is effected using a low UMC imaging member.

5. The method according to claim 4 wherein said low UMC imaging member comprises a 300 SPI device.

6. The method according to claim 5 wherein said areas of relatively low voltage are developed with black toner.

7. The method according to claim 6 wherein said areas of relatively high voltage are developed with colored toner.

8. The method according to claim 3 wherein said high resolution development system comprises insulative magnetic brush development.

9. Apparatus for forming plural images using a charge retentive belt, said apparatus comprising:

means for uniformly charging said belt;

means for discharging portions of said uniformly charged retentive belt to form relatively high and low voltage areas of the same polarity on said belt;

a high resolution development system for developing said areas of relatively low voltage;

means for electrically biasing of said development system such that a relatively large development field is provided between said developer structure forming a part of said development system and said relatively low voltage;

means for discharging portions of said relatively high voltage areas of said charge retentive belt to form areas at a voltage level intermediate said relatively high and low voltage areas; and means for developing said areas of high voltage level with a second toner material which is distinct from said first toner material.

10. Apparatus according to claim 9 wherein said high resolution development system comprises a plurality of developer rolls positioned in intimate contact with said charge retentive belt.

11. Apparatus according to claim 10 wherein said relatively high and low voltage areas are formed using a 600 SPI raster output scanner.

12. Apparatus according to claim 11 wherein said means for discharging portions of said relatively high voltage comprises a low UMC imaging member.

13. Apparatus according to claim 12 wherein said low UMC imaging member comprises a 300 SPI device.

14. Apparatus according to claim 13 wherein said areas of relatively low voltage area developed with black toner.

15. The method according to claim 14 wherein said areas of relatively high voltage are developed with colored toner.

16. The method according to claim 10 wherein said high resolution development system comprises insulative magnetic brush development.

17. The method according to claim 6 wherein a conductive magnetic brush development system is used for developing said areas of relatively high voltage.

18. Apparatus according to claim 13 including conductive magnetic brush development means for developing said relatively high voltage areas.

19. Apparatus according to claim 18 wherein said conductive magnetic development system comprises colored toner.

* * * * *